US009988795B2

(12) United States Patent
Hooijmans

(10) Patent No.: US 9,988,795 B2
(45) Date of Patent: Jun. 5, 2018

(54) LIP SHROUD FOR A DRAGLINE LIP

(71) Applicant: Caterpillar Work Tools B.V., s-Hertogenbosch (NL)

(72) Inventor: Willem J. Hooijmans, Kerkdriel (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 0 days. days.

(21) Appl. No.: 15/121,149

(22) PCT Filed: Feb. 26, 2015

(86) PCT No.: PCT/EP2015/054096
§ 371 (c)(1),
(2) Date: Aug. 24, 2016

(87) PCT Pub. No.: WO2015/128442
PCT Pub. Date: Sep. 3, 2015

(65) Prior Publication Data

US 2016/0369481 A1 Dec. 22, 2016

(30) Foreign Application Priority Data

Feb. 28, 2014 (EP) ..... 14157321

(51) Int. Cl.
*E02F 9/28* (2006.01)
*E02F 3/60* (2006.01)

(52) U.S. Cl.
CPC ..... *E02F 9/2883* (2013.01); *E02F 3/60* (2013.01); *E02F 9/2808* (2013.01); *E02F 9/2858* (2013.01)

(58) Field of Classification Search
CPC ..... E02F 9/2883; E02F 9/2825; E02F 9/2833; E02F 9/28; E02F 9/2841; E02F 9/2816; E02F 9/2858; E02F 9/2808; E02F 3/60; Y10T 403/479
USPC ..... 37/446, 451, 452, 456, 444; 172/745, 172/772; 403/272
See application file for complete search history.

(56) References Cited

U.S. PATENT DOCUMENTS 5,088,214 A 2/1992 Jones
5,526,592 A 6/1996 Bierwith
5,553,409 A 9/1996 Living
(Continued)

FOREIGN PATENT DOCUMENTS

WO WO 2002-012642 2/2002
WO WO 2013-067585 5/2013

OTHER PUBLICATIONS

International Search Report dated May 7, 2015, issued in PCT-EP2015-054096 (2 pages).
(Continued)

*Primary Examiner* — Robert E Pezzuto

(57) ABSTRACT

A lip shroud for a dragline lip configured to prevent wear on the dragline lip and to prevent decoupling therefrom during operations. The lip shroud comprises of a first sidewall having a first abutment surface provided with an opening; a second sidewall having a second abutment surface wherein the second sidewall has a securing portion configured for coupling to a lock device on the dragline lip; and a center wall having a third abutment surface, the center wall connecting the first sidewall and the second sidewall wherein the first, second and third abutment surfaces define a channel to receive an edge portion of the dragline lip.

20 Claims, 7 Drawing Sheets

(56) References Cited

U.S. PATENT DOCUMENTS

| | | | | |
|---|---|---|---|---|
| 5,937,549 | A * | 8/1999 | Bender | E02F 9/2825 172/772 |
| 6,145,224 | A * | 11/2000 | Stickling | E02F 9/2825 37/456 |
| 7,596,895 | B2 | 10/2009 | Jones | |
| 8,024,874 | B2 | 9/2011 | McClanahan et al. | |
| 8,925,220 | B2 * | 1/2015 | Stangeland | E02F 9/2883 37/452 |
| 9,593,470 | B2 * | 3/2017 | Dallard | E02F 3/40 |
| 2004/0098886 | A1 | 5/2004 | Hohmann et al. | |
| 2007/0204490 | A1 * | 9/2007 | Jones | E02F 9/28 37/452 |
| 2013/0185965 | A1 | 7/2013 | Bartolome Rodriguez | |
| 2013/0247427 | A1 | 9/2013 | Compomanes | |

OTHER PUBLICATIONS

European Search Report dated May 13, 2014, issued in EP 14157321.2 (3 pages).

* cited by examiner

LIP SHROUD FOR A DRAGLINE LIP

CLAIM FOR PRIORITY

This application is a U.S. National Phase entry under 35 U.S.C. § 371 from PCT International Application No. PCT/EP2015/054096, filed Feb. 26, 2015, which claims benefit of priority of European Patent Application No. 14157321.2, filed Feb. 28, 2014, all of which are incorporated herein by reference.

TECHNICAL FIELD

This disclosure relates to the field of replaceable wear parts, in particular to a replaceable wear part for protection of a leading edge of an earthmoving implement such as a drag line bucket, a face shovel, buckets for front-end loaders, excavators and the like.

BACKGROUND

Mining and earthmoving operations require a ground engaging implement that may be generally provided on a vehicle. The ground engaging implement may be a bucket such as a dragline bucket or an excavator bucket. The leading edges of the bucket may be subjected to wear during the mining and earthmoving operations. The leading edges may include the digging edge and structural elements that support the digging edge. In order to protect these leading edges from wear a wear member may be used.

The wear members may be bolted to the leading edges such as the portions between the respective tip assemblies on the digging edge and the structural elements supporting the digging edge. In other applications, the wear members may be fastened to the individual tip assemblies by various forms of fasteners or mechanical interlock systems.

The wear members may be welded to leading edges of the bucket to increase the usable life of the implement. The wear members may operate in harsh working conditions and may be subjected to heavy loading and a high degree of wear so as to protect the leading edges from premature wear. Accordingly, the wear members may wear out frequently and require periodic replacement.

Hence, there is a need to be able to quickly and easily remove a worn wear member and to replace it. However, wear members that are welded to the leading edges may require substantial dismantling of the bucket for their removal. Further complications may arise when mechanical fastening methods, such as bolts or pins, are used to attach the wear members. The mechanical fasteners are required to withstand large forces that may arise during the mining and earth moving operations. These forces may result in deformation of the mechanical fastener, thereby rendering the removal of the wear members more difficult.

Thus, a quick and easy removal of the wear members is required while ensuring that the wear members are securely mounted in a manner to withstand the considerable forces exerted thereon during operation.

U.S. Pat. No. 5,088,214 describes a replaceable wear edge for the forward edge of an excavator such as the lip or wing and which may include a U-shaped wear member. The wear member may be equipped with a T-shaped slot engageable with a conforming T-shaped boss on a confronting surface on the excavator. The wear member upper surface may be equipped with a keeper-equipped opening for receiving a lock between the boss and wear member. Wear member may have spaced apart rearwardly extending legs having slots to receive the boss.

U.S. Pat. No. 5,553,409 describes a wear protector system for shielding the leading edge of an earthmoving implement. The system includes an arrangement of shrouds that may cover the leading edge between the laterally spaced digger teeth. Each shroud may have a nose portion that wraps around the leading edge and a rearwardly extending tail portion having an abutment surface that engages an undercut abutment surface of an anchor block that is welded to the bucket. The complementary abutment surfaces may retain the tail portion from moving upwardly away from the bucket surface. The shroud may be retained from movement forwardly out of engagement with the lip by use of a cotter pin extending transversely through a passage that is formed partially in the tail of the shroud.

U.S. Pat. No. 8,024,874 describes a wear member that includes a pair of legs defining a slot straddling the digging edge of a piece of excavating equipment. In one construction, the slot is formed at its front end with a pair of inclined surfaces and a laterally extending ridge that is fit within a complementary channel on the digging edge. A lock is received within an opening in the wear member to releasably secure the wear member to the digging edge.

The present disclosure is directed, at least in part, to improving or overcoming one or more aspects of the prior art system.

BRIEF SUMMARY OF THE INVENTION

In a first aspect, the present disclosure describes a lip shroud for a dragline lip. The lip shroud may comprise a first sidewall having a first abutment surface provided with an opening; a second sidewall having a second abutment surface wherein the second sidewall has a securing portion configured for coupling to a lock device on the dragline lip; and a centre wall having a third abutment surface, the centre wall connecting the first sidewall and the second sidewall wherein the first, second and third abutment surfaces define a channel to receive an edge portion of the dragline lip.

In a second aspect, the present disclosure describes a dragline lip assembly. The dragline lip assembly may comprise a dragline lip comprising at least one edge portion having a boss; and a lip shroud. The lip shroud may comprise a first sidewall having a first abutment surface provided with an opening; a second sidewall having a second abutment surface wherein the second side wall has a securing portion configured for coupling to a lock device on the dragline lip; and a centre wall having a third abutment surface, the centre wall connecting the first sidewall and the second sidewall wherein the first, second and third abutment surfaces define a channel to receive the at least one edge portion of the dragline lip wherein the boss is insertable in the opening.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a lip shroud for assembly onto a ground engaging implement. The lip shroud may be used to protect a leading edge of the ground engaging implement from wear. In an embodiment, the ground engaging implement may be a dragline bucket.

Figure 1:
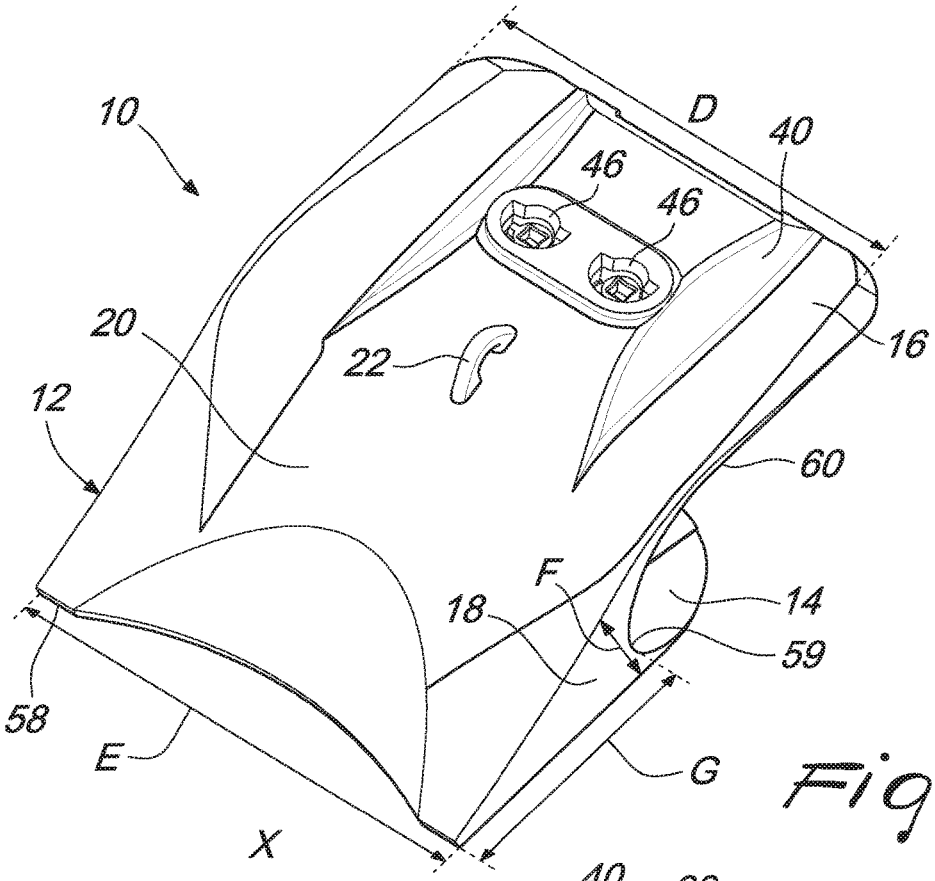
FIG. 1 is a first isometric view of a lip shroud according to the present disclosure.

FIG. 1 illustrates a lip shroud 10 for mounting to a dragline lip (not shown). The lip shroud 10 may comprise a first sidewall 14, a second sidewall 16 and a centre wall 18. The first sidewall 14, second sidewall 16 and centre wall 18 may be formed as a monolithic body 12. In an embodiment, first sidewall 14, second sidewall 16 and centre wall 18 may be separately formed structures that are joined together to form the body 12.

Lip shroud 10 may comprise a wear surface 20 that extends along the surfaces of the first sidewall 14, the second sidewall 16 and the centre wall 18. Wear surface 20 may be the outer surface of body 12 that contacts material during work operations. One or more hoist loops 22 may be positioned on the wear surface 20 to enable ease of handling by a hoist during attachment and removal operations of the lip shroud 10.

Figure 2:
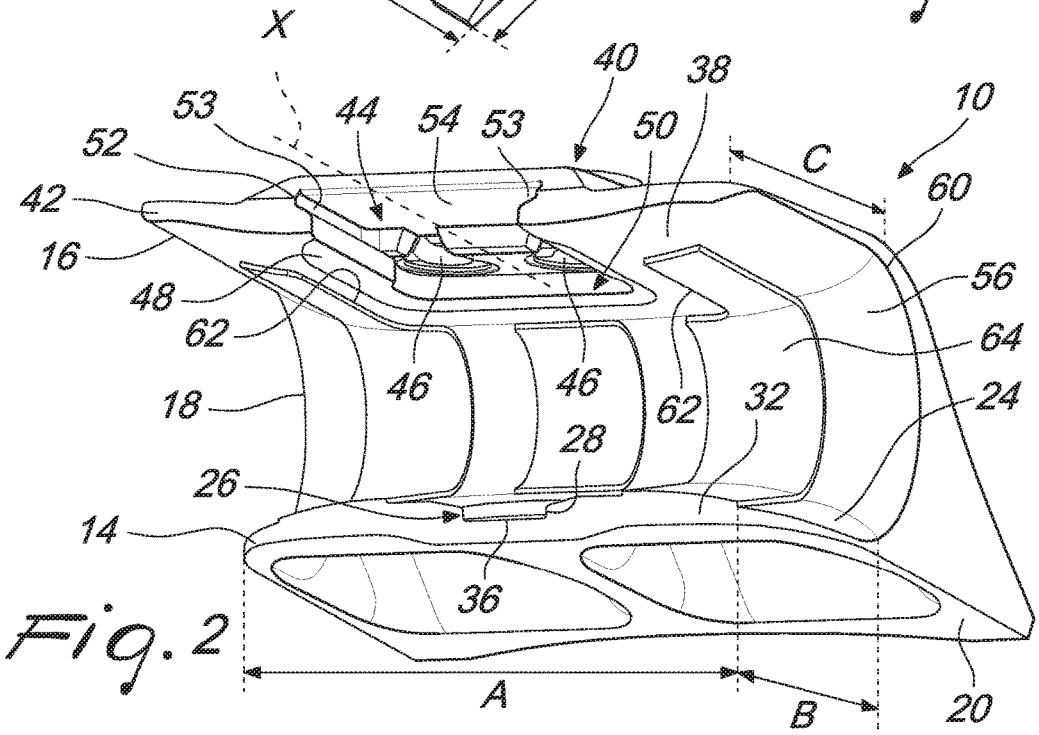
FIG. 2 is a second isometric view of the lip shroud according to the present disclosure.

With reference to FIG. 2, the first sidewall 14 may have a first abutment surface 24 of the lip shroud 10. First abutment surface 24 may be on the side of the first sidewall 14 opposite to the side with the wear surface 20. First abutment surface 24 may abut a portion of the dragline lip (not shown). First abutment surface 24 may be provided with a first free edge 32 of the lip shroud 10. First abutment surface 24 may be a curved surface having ends that are curved towards the wear surface 20.

Figure 3:
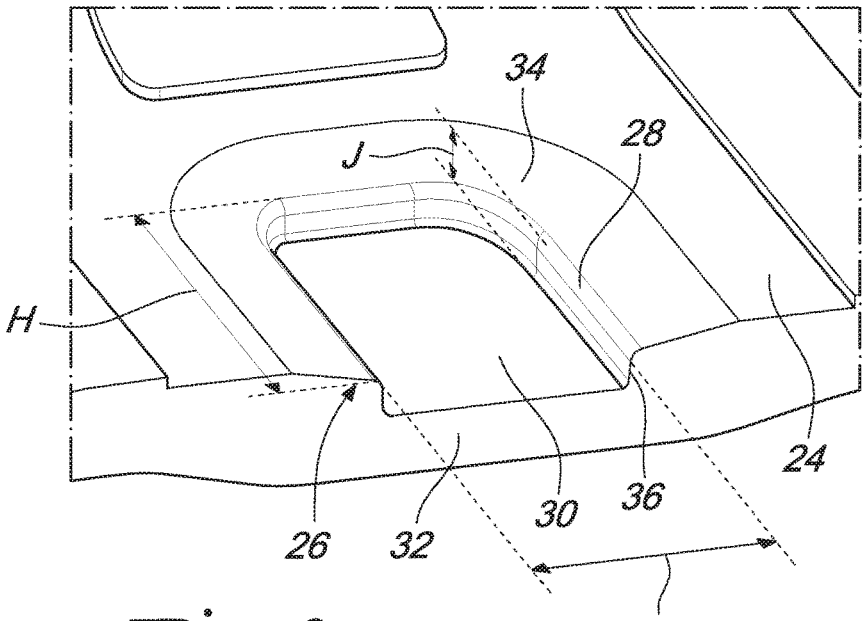
FIG. 3 is an isometric view of a portion of a lip shroud of FIG. 1.

With reference to FIGS. 2 and 3, first abutment surface 24 may be provided with an opening 26. Opening 26 may be quadrangular in shape. Opening 26 may have sides 28. Sides 28 may be orthogonal to a portion of the first abutment surface 24. The portion of the first abutment surface 24 may be the portions adjacent to sides 28. In an alternate embodiment, sides 28 may be orthogonal to the first abutment surface 24. Opening 26 may have a floor 30. In a further embodiment, floor 30 may be parallel to the first abutment surface 24. Floor 30 may be orthogonal to the sides 28. Opening 26 may be centrally aligned on the third abutment surface 24. In an embodiment, a sloped wall 34 may connect the sides 28 to the first abutment surface 24.

In an embodiment, opening 26 may be contiguous with the first free edge 32 of the lip shroud 10. Opening 26 may be bordered by the sides 28 on three sides and may not be enclosed on a fourth side. Opening 26 may be at least partially accessible at the unobstructed fourth side.

The opening 26 may be located at the first free edge 32. The opening 26 may be at least partially accessible through the first free edge 32. First free edge 32 may have a breach 36 which enables passage into the opening 26. Sides 28 adjacent to the breach 36 may be normal thereto. Side 28 opposite the breach 36 may be parallel thereto. Side 28 opposite the breach 36 may connected to sides 28 that are adjacent to the breach 36 by curvatures 29. The curvatures 29 may have a radius ranging from 23 mm to 27 mm. The curvatures 29 may have a radius of 25 mm. In a further embodiment, the three sides 28 may be bordered by three respective sloped walls 34.

Opening 26 may have a length H ranging from 72 mm to 82 mm. Opening 26 may have a length H of 77 mm. Opening 26 may have a width I ranging from 100 mm to 105 mm. Opening 26 may have a width I of 102.01 mm. Opening 26 may have a depth J ranging from 10.8 mm to 14.8 mm. Opening 26 may have a depth J of 12.8 mm.

The opening 26 may be formed in a suitable shape and may have suitable dimensions to receive a boss (not shown) provided on the dragline lip (not shown). In an alternative embodiment, the opening 26 may be a through opening so as to extend through the first sidewall 14 and to be accessible through both the first abutment surface 24 and the wear surface 20.

With reference to FIGS. 1 and 2, first sidewall 14 may have a plate-like structure with curved ends. First sidewall 14 may have a length A ranging from 530 mm to 550 mm. First sidewall 14 may have a length A of 540 mm. First sidewall 14 may have a width B ranging from 200 mm to 220 mm. First sidewall 14 may have a width B of 210 mm. In an embodiment, first sidewall 14 may have a wing-like structure.

With reference to FIGS. 1 and 2, the second sidewall 16 may have a second abutment surface 38 of the lip shroud 10. Second abutment surface 38 may be on the side of the second sidewall 16 opposite to the side with the wear surface 20. Second abutment surface 38 may abut a portion of the dragline lip (not shown). Second abutment surface 38 may be a curved surface having ends that are curved towards the wear surface 20.

The second sidewall 16 may have a securing portion 40 configured for coupling to a lock device (not shown) that is positioned on the dragline lip. Securing portion 30 may be recessed into the second abutment surface 38. Securing portion 40 may be extended in a direction normal to the longitudinal axis of the second sidewall 16. Securing portion 40 may be truncated at a second free edge 42 of the lip shroud 10. Securing portion 40 may have a longitudinal axis X. Longitudinal axis X may be substantial to the longitudinal axis of the second sidewall 16. Securing portion 40 may be extended in a direction along the longitudinal axis X.

Securing portion 40 may be configured to have a centrally located void 44. Void 44 may be extended in a direction transverse to both the longitudinal axis of the second sidewall 16. Void 44 may extend to second free edge 42 of the lip shroud 10. Void 44 may be accessed through the second abutment surface 38 and through apertures 46 provided in the securing portion 40. The apertures 46 may be located opposite the second sidewall 16. Apertures 46 may be parallel to the second sidewall 16. A plane transversally intersecting the apertures 46 may be parallel to the second sidewall 16. Apertures 46 may be parallel to the second abutment surface 38. A plane transversally intersecting the apertures 46 may be parallel to the abutment surface 38.

Securing portion 40 may comprise a base 48 that is joined to the second abutment surface 38. Base 48 may be recessed from the second abutment surface 38. Base 48 may be contiguous with the second abutment surface 38. Base 48 may form a three sided border around a portion of void 44. Base 48 may be inclined relative to the second abutment surface 28.

Securing portion 40 may comprise a confine 50 extending from the base 48 inwards into the securing portion 40. Confine 50 may project in a direction substantially away from the second abutment surface 38. Confine 50 may form a three sided border around a portion of void 44 that is contiguous with the border formed by the base 48.

Securing portion 40 may comprise a stepped portion 52 joined to the confine 50 along an edge opposite to the edge joined to the base 48. The stepped portion 52 may form a two sided border around a portion of void 44 that is contiguous with the border formed by the confine 50. The two sided border may comprise two sides that are mutually opposite. The stepped portion 52 may be transversally wider relative to the confine 50. Stepped portion 52 may form passages 53 on the confine 50. Passages 53 may be mutually parallel. Passages 53 may be parallel the longitudinal axis X. Passages 53 may be laterally recessed into the securing portion 40. Passages 53 may be accessible from the second free edge 42. The stepped portion 52 may receive a lock device (not shown).

The stepped portion 52 may connect the two opposite sides by a ceiling 54 that extends over a portion of the void 44. The ceiling 54 may lie on a plane whereon lie the openings of the apertures 46. A portion of the lock device (not shown) may be held between the ceiling 54 and the confine 50.

With reference to FIG. 2, second sidewall 16 may have a plate-like structure with curved ends and provided with a protuberance in the form of the securing portion 40. The curved ends may be spaced from the securing portion 40. Second sidewall 16 may have a length C ranging from 453 mm to 463 mm. Second sidewall 16 may have a length C of 458 mm. With reference to FIG. 1, second sidewall 16 may have a width D ranging from 535 mm to 545 mm. Second sidewall 16 may have a width D of 540 mm.

With reference to FIG. 2, the centre wall 18 may have a third abutment surface 56 of the lip shroud 10. Third abutment surface 56 may be on the side of the centre wall 18 opposite to the side with the wear surface 20. Third abutment surface 56 may abut a portion of the dragline lip (not shown).

With reference to FIG. 1, centre wall 18 may have an apex 58 that forms the tip of the lip shroud 10. Central portion of the apex 58 may be recessed into the centre wall 18. Wear surface 20 adjacent to the apex 58 may be sunken into the centre wall 18. Centre wall 18 may have a cross section of a triangle with a base 59 that is curved. The base 59 may be curved in the direction away from the apex 58. Base 59 may be curved in the direction away from the apex 56. The base 59 may have a radius ranging from 69 mm to 73 mm. The base 59 may have a radius of 71 mm. Third abutment surface 56 comprise the base 59. Third abutment surface 56 may have a C-shaped cross section. Apex 58 may be offset relative to the centre of third abutment surface 56.

Centre wall 18 may have a length E ranging from 535 mm to 545 mm. Centre wall 18 may have a length E of 540 mm. Centre wall 18 may have a width F ranging from 257 mm to 267 mm. Centre wall 18 may have a width F of 262 mm. Centre wall 18 may have a height G ranging from 360 mm to 370 mm. Centre wall 18 may have a height G of 365 mm.

Figure 4:
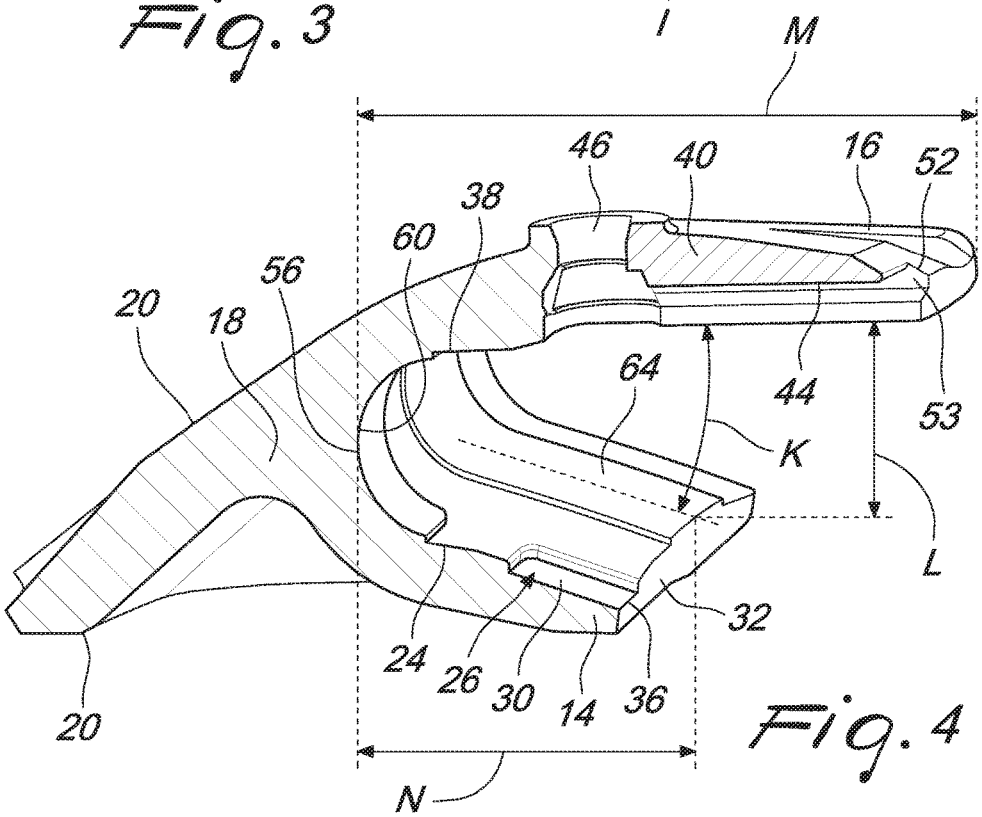
FIG. 4 is a cross section of the lip shroud of FIG. 1.

With respect to FIG. 4, the centre wall 18 may connect the first sidewall 14 and the second sidewall 16. First and second sidewall 14, 16 may be bifurcate extensions of the lip shroud 10 from the centre wall 18. First and second sidewall 14, 16 may be mutually angularly spaced. First sidewall 16 may extend further from the centre wall 18 relative to second sidewall 14. First free edge 32 may extend to securing portion 30. First free edge 32 may extend to apertures 46.

The first, second and third abutment surfaces 24, 38, 56 may define a channel 60. The first, second and third abutment surfaces 24, 38, 56 may form a contiguous abutment surface. Channel 60 may be formed interiorly relative to the external wear surface 20. Channel 60 may be configured to receive a structural element of the dragline lip. The channel 60 may have a substantially U shaped cross section.

The length of the channel 60 may be defined by the first, second and third abutment surfaces 24, 38, 56. The channel 60 may have a length M ranging from 453 mm to 463 mm along the second abutment surface 38. The channel 60 may have a length M of 458 mm along the second abutment surface 38. The channel 60 may have a length N ranging from 204 mm to 214 mm along the first abutment surface 24. The channel 60 may have a length N of 209 mm along the first abutment surface 24.

The first abutment surface 24 at the first free edge 32 may be linearly spaced from the second abutment surface 38 by a distance L ranging from 173 mm to 183 mm. The first abutment surface 24 at the first free edge 32 may be linearly spaced from the second abutment surface 38 by a distance L of 178 mm. With reference to FIG. 2, the lip shroud 10 may have at least one raised contact portion 64. The at least one raised contact portion 64 may be positioned on the first, second and third abutment surfaces 24, 38, 56. Raised contact portion 64 may be contiguous with a first free edge 32 of the lip shroud 10. The raised contact portion 64 may be substantially U-shaped.

Raised contact portion 64 may eliminate the need for full surface contact between the lip shroud 10 and the dragline lip. Full contact surfaces may require closer manufacturing tolerances. The raised contact portion 64 may enable easier working during servicing instead of a full contact surfaces.

With reference to FIG. 4, in an embodiment, The raised contact portion 64 at the first free edge 32 may be linearly spaced from the second abutment surface 38 by a distance L ranging from 173 mm to 183 mm. The raised contact portion 64 at the first free edge 32 may be linearly spaced from the second abutment surface 38 by a distance L of 178 mm.

In a further embodiment, first abutment surface 24 may have a plurality of raised contact portions 64. The raised contact portions 64 may be positioned in an arrangement. The raised contact portions 64 may be arranged in a plurality of rows. The raised contact portions 64 may extend from the first abutment surface 24 across the third abutment surface 56 to the second abutment surface 38. The plurality of rows may be parallel. In an alternative embodiment, the raised contact portions 64 may be arranged in a staggered arrangement.

In yet a further embodiment, a raised contact portion 64 may be provided centrally on the third abutment surface 56 and positioned between the securing portion 40 and the opening 26. Two raised contact portions 64 may be provided on either side of the centrally positioned raised contact portion 64. The laterally positioned raised contact portions 64 may extend from the first free edge 32 to the second abutment surface 38. The laterally positioned raised contact portions 64 may be provided with cut-outs 62 adjacent to the securing portion 40.

In yet a further embodiment, first abutment surface 24 may have a plurality of indentations positioned in an arrangement. The indentations may be arranged in a plurality of rows. The plurality of rows may be parallel. Alternatively, indentations may be arranged in a staggered arrangement.

With reference to FIG. 4, the first sidewall 14 may be inclined relative to the second sidewall 16. The first abutment surface 24 may be inclined relative to the second abutment surface 38. First and second sidewall 14, 16 may be angularly spaced by an angle K ranging from 11 degrees to 15 degrees. First and second sidewall 14, 16 may be angularly spaced by an angle K ranging of 13 degrees. In an alternative embodiment, the first sidewall 14 may be substantially parallel to the second sidewall 16. The first abutment surface 24 may be substantially parallel to the second abutment surface 38.

The raised contact portion 64 on the first abutment surface 24 may have a surface that is inclined relative to a surface of the raised contact portion 64 on the second abutment surface 38. In an embodiment, the surfaces of the plurality of raised contact portions 64 on the respective first abutment surface 24 may be inclined relative to the surfaces of the plurality of raised contact portions 64 on the second abutment surface 38. In an alternative embodiment, the surfaces of plurality of raised contact portions 64 on the first abutment surface 24 may be substantially parallel to the surfaces on the second abutment surface 38.

The void 44 may be recessed in a direction inclined relative to the first abutment surface 24. The void 44 may be recessed in a direction inclined relative to the surface of the at least one raised contact portion 64 or the surfaces of the plurality of raised contact portions 64 on the first abutment surface 24. A plane transversally intersecting apertures 46 may be inclined relative to the first abutment surface 24. A plane transversally intersecting apertures 40 may be inclined relative to the surface of the at least one raised contact portion 64 or the surfaces of the plurality of raised contact portions 26 on the first abutment surface 24.

Opening 26 may be inclined relative to the second sidewall 16. Opening 26 may be inclined relative to the second abutment surface 38. A plane transversally intersecting the opening 26 may be inclined relative to the second abutment surface 38. Floor 30 may be inclined relative to the second sidewall 16. Floor 30 may be inclined relative to the second abutment surface 38. Floor 30 may be inclined relative to the ceiling 54. Floor 30 may be inclined relative to the stepped portion 52. Floor 30 may be inclined to the second abutment surface 38, the ceiling 54 or the stepped portion 52 by an angle ranging from 11 degrees to 15 degrees. Floor 30 may be inclined to the second abutment surface 38, the ceiling 54 or the stepped portion 52 by an angle of 13 degrees.

Opening 26 may be inclined to the surface of the at least one raised contact portion 64 or the surfaces of the plurality of raised contact portions 26 on the second abutment surface 38. A plane transversally intersecting the opening 26 may be inclined relative to the surface of the at least one raised contact portion 64 or the surfaces of the plurality of raised contact portions 64 on the second abutment surface 38. Floor 30 may be inclined relative to the surface of the at least one raised contact portion 64 or the surfaces of the plurality of raised contact portions 64 on the second abutment surface 38.

In an alternative embodiment, opening 26 may be substantially parallel to the second abutment surface 38. Opening 26 may be substantially parallel to the second abutment surface 38. A plane transversally intersecting the opening 26 may be substantially parallel to the second abutment surface 38. Floor 30 may inclined relative to the second abutment surface 38.

Opening 26 may be substantially parallel to the surface of the at least one raised contact portion 64 or the surfaces of the plurality of raised contact portions 64 on the second abutment surface 38. A plane transversally intersecting the opening 26 may be substantially parallel to the surface of the at least one raised contact portion 64 or the surfaces of the plurality of raised contact portions 64 on the second abutment surface 38. Floor 30 may substantially parallel to the surface of the at least one raised contact portion 64 or the surfaces of the plurality of raised contact portions 64 on the second abutment surface 38.

The opening 26 may be centrally aligned on the first abutment surface 24 and the securing portion 40 may be centrally aligned on the second sidewall 16. Opening 26 may face the securing portion 40. Sides 28 may be extended from the first abutment surface 24 in a direction away from the securing portion 40. Sides 28 of the opening 26 may be substantially orthogonal to the securing portion 40.

At least one side 28 may be substantially orthogonal to the longitudinal axis X of the securing portion 40. At least one side 28 may be substantially orthogonal to the passages 53 of the securing portion 40. At least one side 28 may be substantially orthogonal to the ceiling 54 of the securing portion 40. The at least one side 28 may be opposite the breach 36.

Sides 28 of the opening 26 may be substantially orthogonal to the second abutment surface 38. Sides 28 may be substantially orthogonal to the surface of the at least one raised contact portion 64 or the surfaces of the plurality of raised contact portions 64 on the second abutment surface 38.

Figure 5:
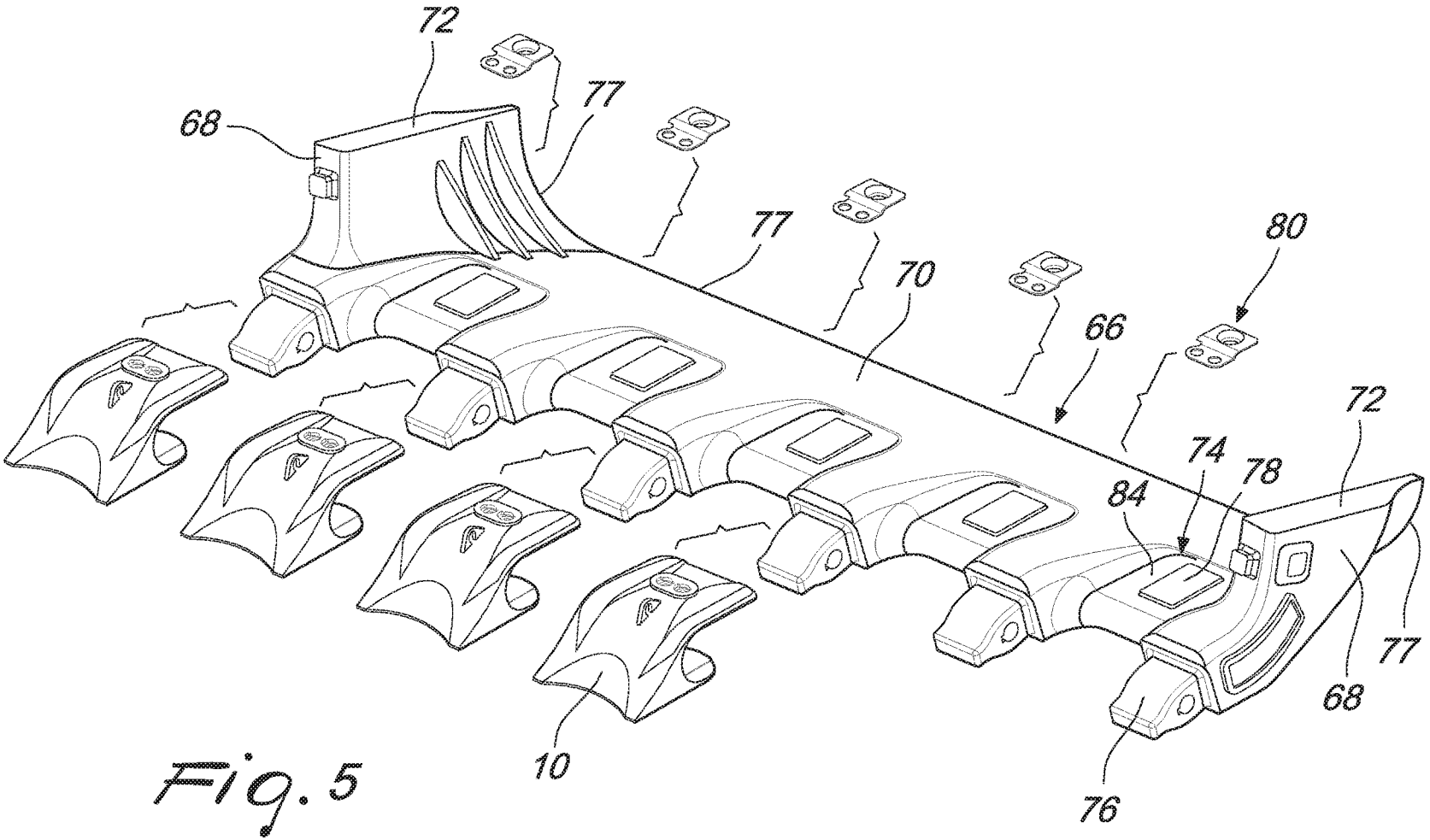
FIG. 5 is an exploded view of the lip shrouds of FIG. 1 and a bucket lip.

FIG. 5 illustrates a dragline lip 66 for a dragline bucket. The dragline lip 66 may be a cast dragline lip 66. Dragline lip 66 may present the leading edge of the dragline bucket and may be subject to wear during mining and earthmoving operations. Dragline lip 66 may have structural elements in the form of upright member 68 and a lip member 70. Upright members 68 may project from the lip member 70 inclined away from the centre of the lip member 70. Each upright member 68 may be inclined at an angle of 4 degrees to 6 degrees from the lip member 70. Each upright member 68 may be inclined at an angle of 5 degrees from the lip member 70. In an embodiment, upright members 68 may project orthogonally from the lip member 70.

The dragline lip 66 may be a monolithic structure. The upright members 68 may be located at opposite ends of the lip member 70 and may be mirror opposites. Upright members 68 may have coupling ends 72 for connection to the respective parts of the dragline bucket.

A coupling surface 77 may extend between the upright members 64 across the lip member 70. The coupling surface 77 may be formed on the side opposite the side receiving the wing shrouds 10. The coupling ends 76 and the coupling surface 77 may be welded to the dragline bucket (not shown).

Lip shrouds 10 may be mountable at the respective edge portions 74 of the lip member 70 for protection thereof from wear. Lip shrouds 10 may have a suitable dimension to fit onto the respective edge portions 74 of the lip member 70. Lip shrouds 10 may be mounted to edge portions 74 between respective tips 76. Lip member 70 may be provided with supporting portions 78 whereon lock assemblies 80 are rigidly mounted. Lock assembly 80 may couple to the securing portion 40 on the respective lip shroud 10. The coupling of the lock assembly 80 to the securing portion 40 enables the lip shroud 10 to be maintained on the edge portion 74.

Figure 6:
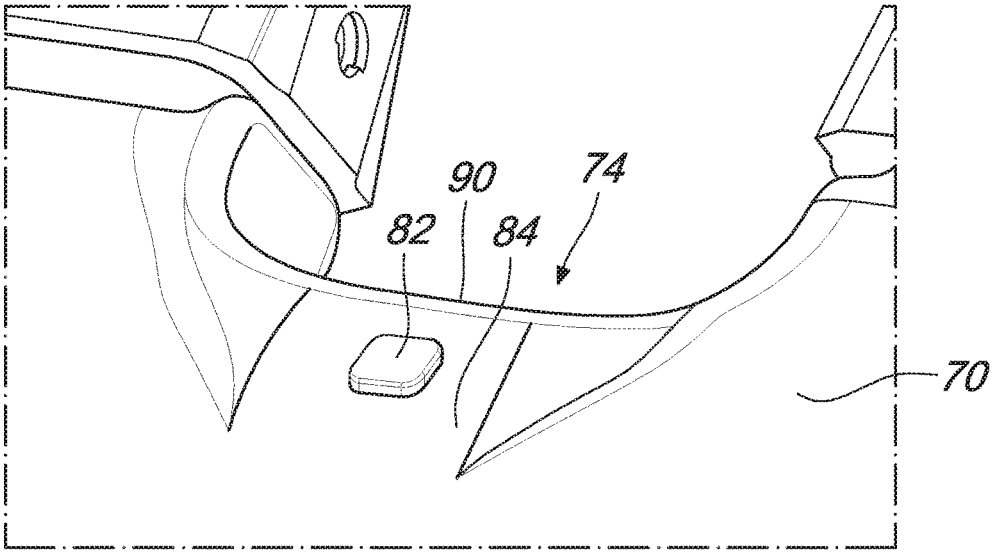
FIG. 6 is an isometric view of a structural element of a bucket lip available for mounting of the lip shroud of FIG. 1.

FIG. 6 illustrates a reverse side of the edge portion 74 of the lip member 70. The edge portion 74 of the lip member 70 may be provided with a boss 82. The boss 82 may be quadrangular in shape. In an embodiment, boss 82 may be suitably shaped and may have a suitable dimension to be inserted into the opening 26 of the lip shroud 10. The boss 82 may be positioned adjacent an abutting crest 90 of the edge portion 74. In an embodiment, the lock assembly 80 may be positioned at substantially the same distance as the boss 82 on opposite sides of the lip member 70 with reference from the abutting crest 84.

Figure 7:
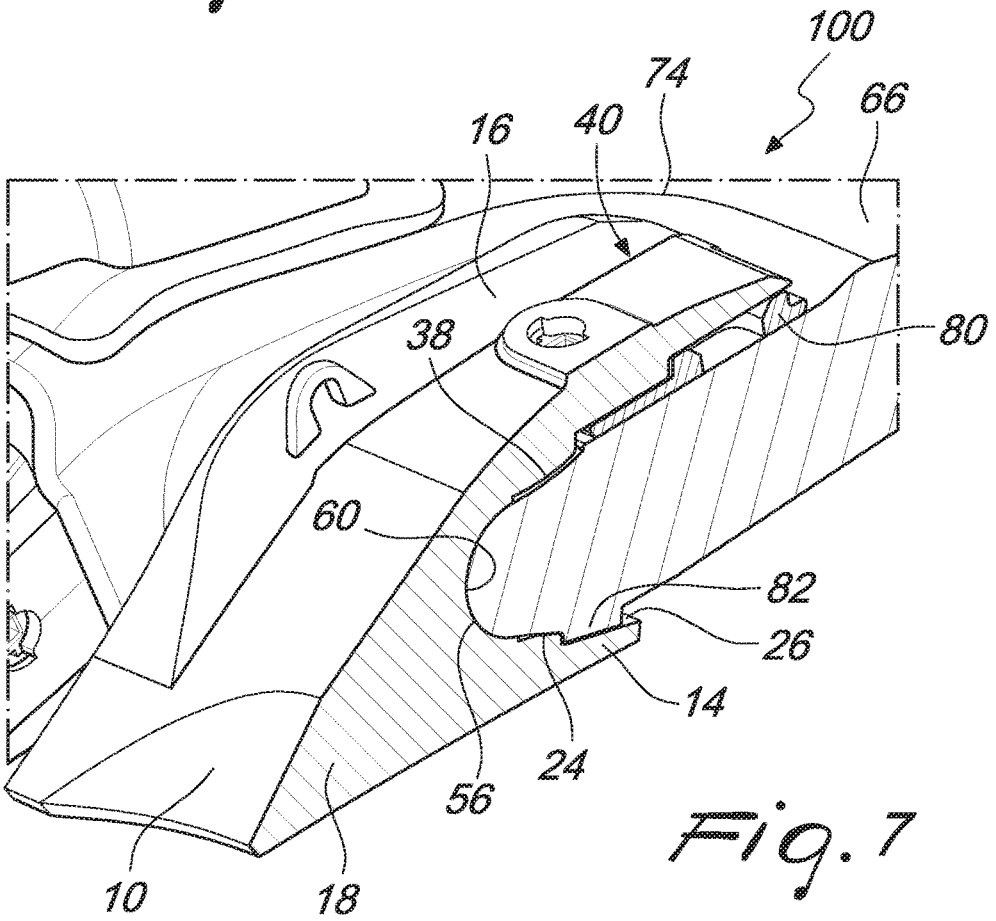
FIG. 7 is a first sectional view of the lip shroud of FIG. 1 mounted on the structural element of FIG. 6.

FIG. 7 illustrates a section of a dragline lip assembly 100 with a lip shroud 10 mounted on a respective lip member 70. The dragline lip assembly 100 may comprise a dragline lip 66 comprising at least one edge portion 74 having a boss 82; and a lip shroud 10. The lip shroud 10 may comprise a first sidewall 14 having a first abutment surface 24 provided with an opening 26; a second sidewall 16 having a second abutment surface 38 wherein the second sidewall 16 has a securing portion 40 configured for coupling to a lock assembly 80 on the dragline lip 66; and a centre wall 18 having a third abutment surface 56, the centre wall 18 connecting the first sidewall 14 and the second sidewall 16 wherein the first, second and third abutment surfaces 24, 38, 56 define a channel 60 to receive the at least one edge portion 74 of the dragline lip 66 wherein the boss 82 is insertable in the opening 26.

Figure 8:
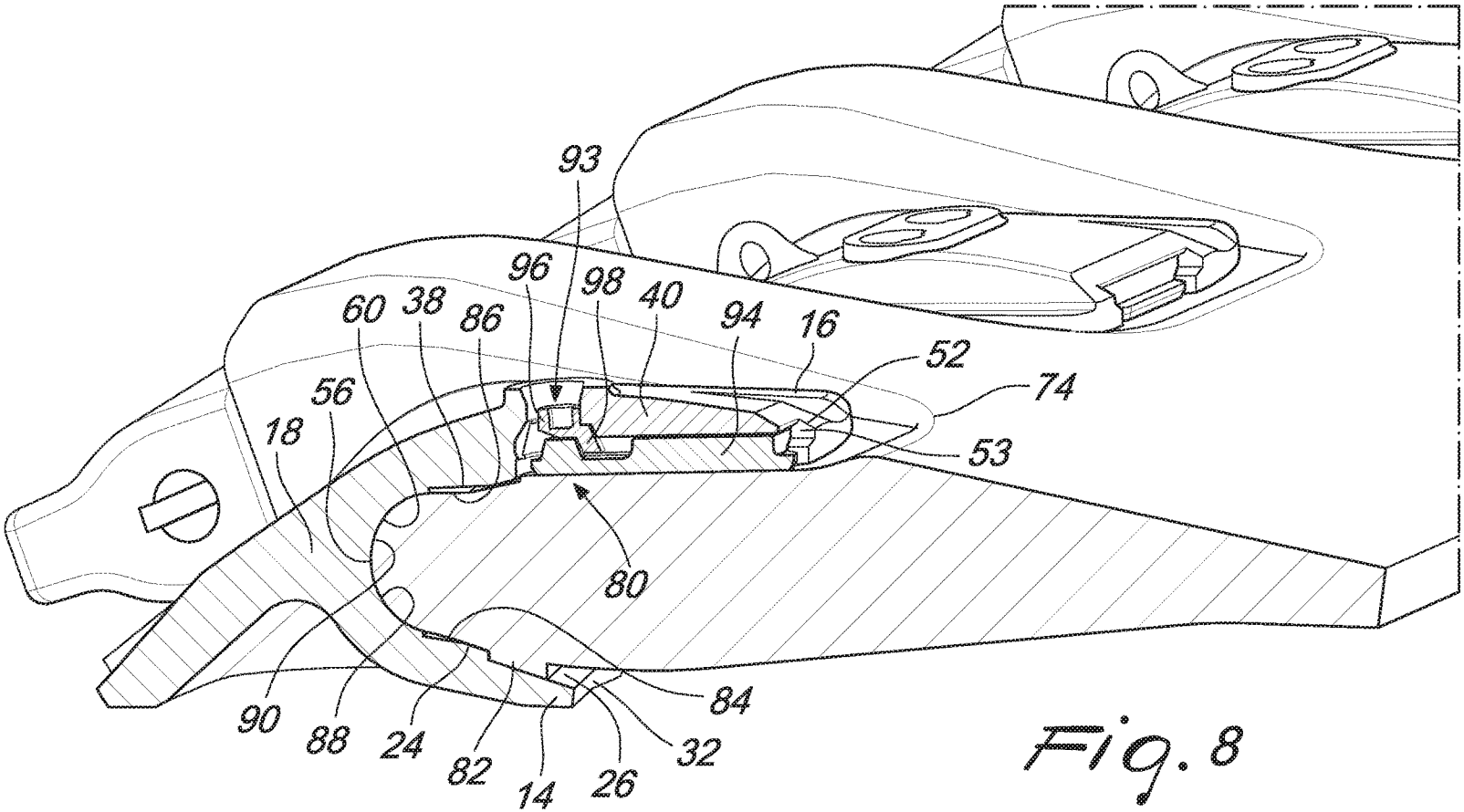
FIG. 8 is a second sectional view of the lip shroud of FIG. 1 mounted on the structural element of FIG. 6.

With reference to FIG. 8, the edge portion 74 may comprise a first contact surface 84 and a second contact surface 86. The second contact surface 86 may have the lock weldment 94. The first and second contact surfaces 84, 86 may be mutually inclined. The first contact surface 84 may be provided with the boss 82. The boss 82 may be inclined relative to the second contact surface 86. The boss 82 may be centrally positioned on the first contact surface 84 and extends away from the second contact surface 86.

The edge portion 74 may further comprise a third contact surface 88 connecting the first contact surface 84 to the second contact surface 86. The third contact surface 88 may have a substantially circular cross section. First contact surface 84 and the second contact surface 86 bifurcate from the third contact surface 88. The third contact surface 88 may be provided with the abutting crest 90. First, second and third contact surfaces 84, 86, 88 may abut respective first, second and third abutment surfaces 24, 38, 56 of the lip shroud 10. First, second and third contact surfaces 84, 86, 88 may fit in the channel 60.

Lock assembly 80 may be coupled to the securing portion 40. Lock assembly 80 may comprise a lock element 93 and a lock weldment 94. The lock element 93 may be inserted into the lip shroud 10 within the void 44 of the securing portion 40. Lock weldment 94 may be welded to the lip member 70. In an embodiment, two lock elements 93 may be provided in the lip shroud 10 within the respective apertures 46.

The lock element 93 may have a first abutment portion 96 and a second abutment portion 98. First lock element 93 may rotatably interact with the securing portion 40. First abutment portion 96 may be rotatably held in the aperture 46. Second abutment portion 98 may abut with the lock weldment 94. In an embodiment, the lock element 93 may be installed in the lip shroud 10 to couple to the lock weldment 94 provided on the dragline lip 66.

Figure 9:
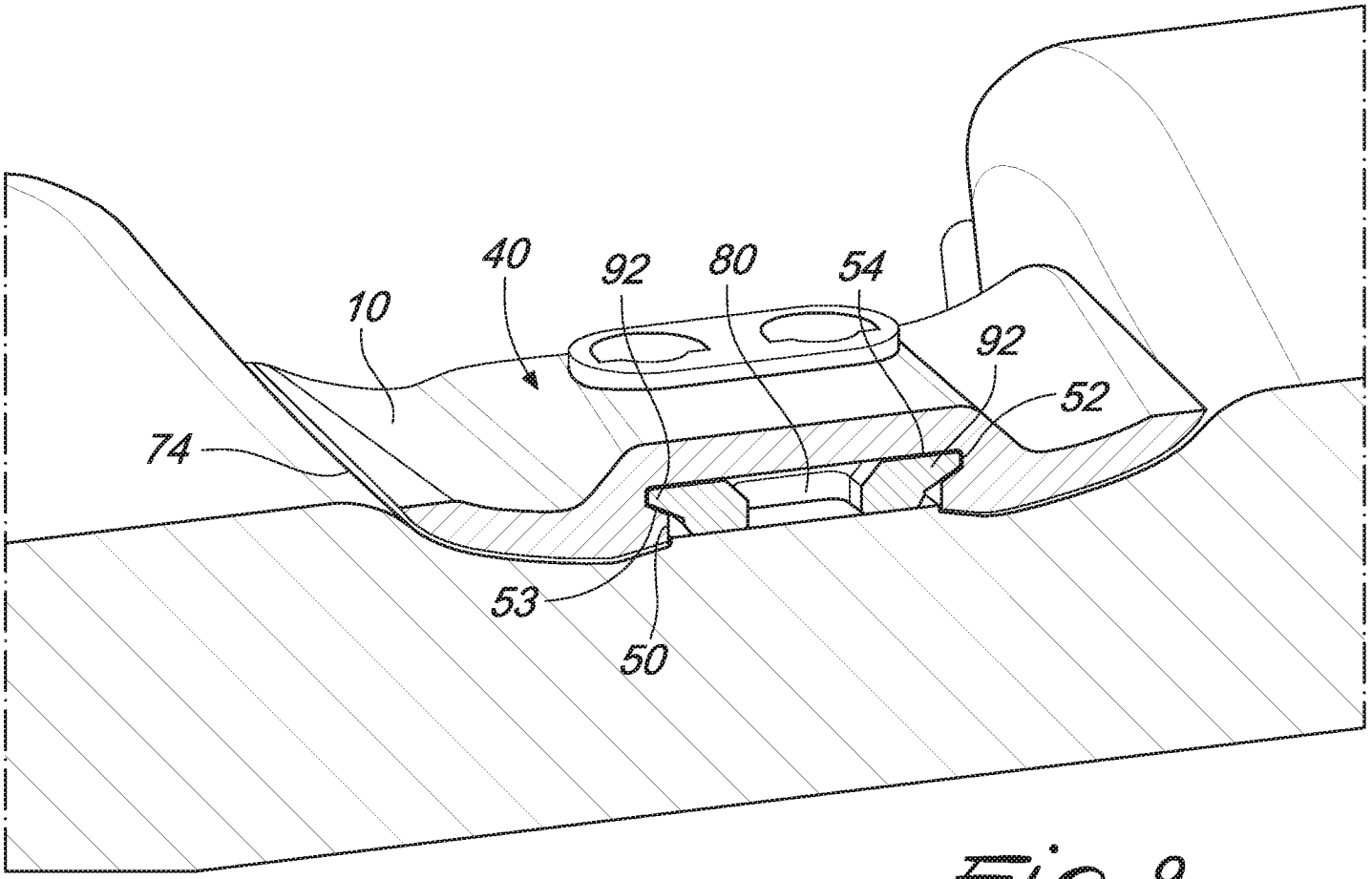
FIG. 9 is a sectional view of the lip shroud of FIG. 1 coupled to a locking device provided on the structural element of FIG. 6.

In a lock position of the lock element 93, the second abutment portion 98 may abut a side of the lock weldment 94 the side furthest from the opening 26 and the boss 82. With the lock element 93 in the lock position, the lock assembly 80 may be interposed between the lip member 66 and the lip shroud 10 to lock translational motion between lip member 66 and the lip shroud 10. FIG. 9 illustrates the coupling of the lip shroud 10 at an edge portion 74. The lock assembly 80 may be coupled to the securing portion 40 of the lip shroud 10. Lock weldment 94 may have wings 92 that engage at the stepped portion 52 of the securing portion 40. Wings 92 may engage into the passages 53 and may be held by confine 50 and ceiling 54.

Figure 10:
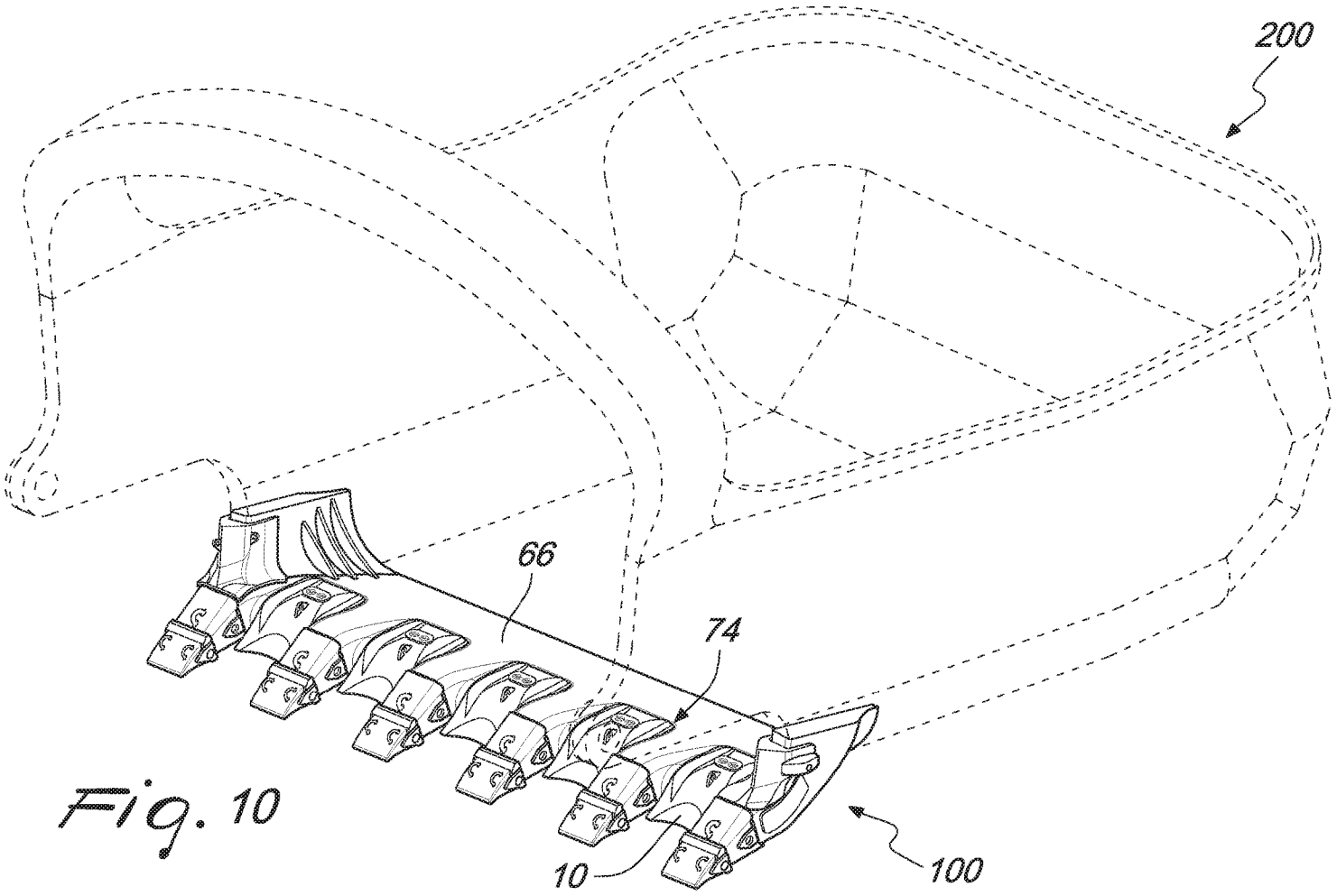
FIG. 10 is an isometric view of a dragline bucket with a bucket lip having lip shrouds mounted thereon.

FIG. 10 illustrates a dragline bucket 200 provided with the dragline lip assembly 100. The dragline lip assembly 100 may have the lip shrouds 10 mounted to the respective edge portions 74 of the lip member 70.

The skilled person would appreciate that foregoing embodiments may be modified or combined to obtain the lip shroud 10 of the present disclosure.

INDUSTRIAL APPLICABILITY

This disclosure describes a lip shroud 10 as a replaceable wear part for a ground engaging implement such as an excavator bucket or a dragline bucket. The lip shroud 10 may be mounted to the bucket. The lip shroud 10 may be mounted to the corresponding structural element of the bucket, in particular between digger teeth provided on the bucket. Lip shroud 10 may shield the structural element of the bucket from wear during operations such as mining and earth moving operations. Lip shroud 10 may be made of materials suitable for the mining and earth moving operations.

Lip shroud 10 may be easily and efficiently mounted on and dismounted from the bucket. Once the lip shroud 10 is consumed during mining and earth moving operations, the lip shroud 10 may be easily replaced with another lip shroud 10.

The mounted lip shroud 10 may be subjected to forces that may result in the decoupling thereof during the mining and earth moving operations. During discharge of material contained in a bucket, the lip shroud 10 may be subjected to forces generated when the bucket contacts the ground, such as during digging operations. Mounted lip shroud 10 may be subjected to forces that tend to effect a rotation thereof relative to the structural element of the bucket. The mounted lip shroud 10 may be subjected to forces that tend to rotate the lip shroud 10 on a surface thereof. Mounted lip shroud 10 may be subjected to a sideways rotational movement. The direction of the forces may be substantially parallel to the apex 58 of the lip shroud 10. The direction of the forces may be substantially parallel to the passages 53 of the securing portion 40. The direction of the forces may be substantially parallel to the wings 92 of the lock weldment 94. The axis of rotation may intersect both the lip shroud 10 and the lip member 70. The coupling of the lock device to the securing portion enables the lip shroud 10 to be maintained on the edge portion 74 in the absence of work operations and during mining and earth mining operations when the material is loaded into the bucket. Lip shroud 10 may avoid being decoupled from the bucket through the interaction of the opening 44 and the boss 66. The interaction between the lock assembly 80 and the securing portion 40 may be provided with greater play relative to the interaction between the opening 26 and the boss 82 such that the load generated by the forces are shared by the interaction between the lock assembly 80 and the securing portion 40 and the interaction between the opening 26 and the boss 82.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The disclosures in European Patent Application No. 14157321.2 from which this application claims priority are incorporated herein by reference.

The invention claimed is:

1. A lip shroud for a dragline lip, the lip shroud comprising:
- a first sidewall having a first abutment surface including an opening;
- a second sidewall having a second abutment surface and a securing portion configured for coupling to a lock assembly on the dragline lip; and
- a centre wall having a third abutment surface, the centre wall connecting the first sidewall and the second sidewall wherein the first, second, and third abutment surfaces define a channel configured to receive an edge portion of the dragline lip.

2. The lip shroud of claim 1 wherein a plane transversally intersecting the opening is inclined relative to the second abutment surface.

3. The lip shroud of claim 1, wherein the first sidewall is inclined relative to the second sidewall.

4. The lip shroud of claim 1, wherein at least one side of the opening is orthogonal to a longitudinal axis (X) of the securing portion.

5. The lip shroud of claim 1, wherein the opening is located at a first free edge, the opening being at least partially accessible through the first free edge.

6. The lip shroud of claim 1, wherein the opening is centrally aligned on the first abutment surface and the securing portion is centrally aligned on the second sidewall.

7. The lip shroud of claim 1, wherein the opening faces the securing portion.

8. The lip shroud of claim 1, wherein the channel has a substantially U shaped cross section.

9. A dragline lip assembly comprising:
- a dragline lip comprising at least one edge portion having a boss; and
- a lip shroud comprising:
  - a first sidewall having a first abutment surface including an opening;
  - a second sidewall having a second abutment surface and a securing portion configured for coupling to a lock assembly on the dragline lip; and
  - a centre wall having a third abutment surface, the centre wall connecting the first sidewall and the second sidewall wherein the first, second, and third abutment surfaces define a channel configured to receive the at least one edge portion of the dragline lip wherein the boss is insertable in the opening.

10. The dragline lip assembly of claim 9 wherein the at least one edge portion further comprises a first contact surface and a second contact surface having a lock device wherein the first and second contact surfaces are mutually inclined.

11. The dragline lip assembly of claim 10 wherein the boss is provided on the first contact surface.

12. The dragline lip assembly of claim 11 wherein a plane transversally intersecting the boss is inclined relative to the second contact surface.

13. The dragline lip assembly of claim 10, wherein the boss is centrally positioned on the first contact surface and extends away from the second contact surface.

14. The dragline lip assembly of claim 10, wherein the at least one edge portion further comprises a third contact surface connecting the first contact surface to the second contact surface, the third contact surface having a substantially circular cross section.

15. The dragline lip assembly of claim 14 wherein the first contact surface and the second contact surface bifurcate from the third contact surface.

16. A dragline bucket, comprising:
- a dragline lip;
- a boss attached to the dragline lip;
- a plurality of digger teeth disposed on the dragline lip;
- a lip shroud, including:
  - a first sidewall having a first abutment surface including an opening;
  - a second sidewall having a second abutment surface and a securing portion; and
  - a centre wall having a third abutment surface, the centre wall connecting the first sidewall and the second sidewall, the first, second, and third abutment surfaces defining a channel configured to receive at least one edge portion of the dragline lip, the boss being insertable in the opening; and
- a lock assembly disposed between the dragline lip and the lip shroud and configured to engage with the securing portion of the second sidewall.

17. The dragline bucket of claim 16, wherein the lip shroud has an apex and the securing portion includes:
- a ceiling;
- a base including a stepped portion disposed opposite the ceiling;
- a recess disposed between the stepped portion and the ceiling;
- an aperture disposed in the ceiling; and
- a void extending from a free edge of the lip shroud towards the apex, the void disposed between the ceiling and the base.

18. The dragline bucket of claim 17, wherein the lock assembly includes:
- a lock element configured to be inserted into the void; and
- a lock weldment attached to the dragline lip.

19. The dragline bucket of claim 18, wherein the lock element includes:
- a first abutment portion rotatably engaged with the aperture; and a second abutment portion abutting the lock weldment.

20. The dragline bucket of claim 18, wherein the lock weldment includes a wing that engages with the recess.

* * * * *